US007827994B2

(12) United States Patent
Spiers et al.

(10) Patent No.: US 7,827,994 B2
(45) Date of Patent: Nov. 9, 2010

(54) METHOD FOR PRODUCING A TOBACCO ROD WITH A HOLLOW PASSAGEWAY EXTENDING THERETHROUGH

(75) Inventors: Steven F. Spiers, Midlothian, VA (US); Wesley G. Sanderson, Chester, VA (US); Steven R. Rinehart, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 497 days.

(21) Appl. No.: 11/964,327

(22) Filed: Dec. 26, 2007

(65) Prior Publication Data

US 2008/0230080 A1 Sep. 25, 2008

Related U.S. Application Data

(60) Provisional application No. 60/877,458, filed on Dec. 28, 2006.

(51) Int. Cl.
*A24C 5/18* (2006.01)

(52) U.S. Cl. ..... 131/84.1; 131/84.3; 131/60; 131/69

(58) Field of Classification Search ..... 131/84.1, 131/84.2, 84.3, 60, 69, 68, 58
See application file for complete search history.

(56) References Cited

U.S. PATENT DOCUMENTS 3,987,804 A * 10/1976 Molins et al. ..... 131/84.3
4,347,855 A 9/1982 Lanzillotti et al.
4,807,809 A 2/1989 Pryor et al.
4,903,712 A * 2/1990 Strydom ..... 131/84.1
5,027,836 A * 7/1991 Shannon et al. ..... 131/194
5,129,409 A * 7/1992 White et al. ..... 131/364
5,690,127 A 11/1997 Chapman et al.
6,152,145 A * 11/2000 Focke ..... 131/58
6,202,648 B1 * 3/2001 Schumacher et al. ..... 131/84.1
2007/0169785 A1 * 7/2007 Gedevanishvili et al. .... 131/361
2008/0163877 A1 * 7/2008 Zhuang et al. ..... 131/71
2009/0014020 A1 * 1/2009 Yoss et al. ..... 131/340

FOREIGN PATENT DOCUMENTS

GB 2078087 1/1982
GB 2275410 A * 8/1994
WO WO-9926495 6/1999

* cited by examiner

*Primary Examiner*—Carlos Lopez
(74) *Attorney, Agent, or Firm*—Connolly Bove Lodge & Hutz LLP

(57) ABSTRACT

The present invention is directed at various apparatus and methods for forming a sealed hollow core tobacco rod. The methods of the invention at least comprise passing a trimmed tobacco column and paper under a tongue that widens and flattens the column and paper; forming the tobacco and paper into a cylindrical shape; forming an inner hollow core; maintaining the hollow core shape; and outputting the sealed hollow core tobacco rod.

8 Claims, 12 Drawing Sheets

METHOD FOR PRODUCING A TOBACCO ROD WITH A HOLLOW PASSAGEWAY EXTENDING THERETHROUGH

CROSS REFERENCE TO RELATED APPLICATION

The present application claims the benefit of provisional application Ser. No. 60/877,458, filed Dec. 28, 2006.

FIELD OF THE INVENTION

The field of the invention relates to apparatus and methods for making cigarettes, and more particularly to making cigarettes with a central hollow passageway.

BACKGROUND OF THE INVENTION

Methods and apparatus of the background art for making cigarettes generally consist of a hopper section that feeds tobacco, and a rod forming section that wraps the tobacco with paper. As shown in background art apparatus 1 of FIG. 43, a porous belt 2, through which air is drawn, runs on two wheels 3, 4. For example, sectional views of the apparatus in FIG. 43 are shown in FIG. 43A-43L. As shown in FIG. 43, tobacco is fed to the porous belt 2 through a tobacco feed chamber 5. As the porous belt 2 passes over the chamber 5, a tobacco column 6 builds up on the porous belt 5 as shown from FIG. 43A to FIG. 43B.

The tobacco column 6 travels with the belt 5 and is contained by the front and rear rails 7, 8 as shown in FIG. 43A to FIG. 43C. In FIG. 43C the tobacco column feeds through two trimming discs 9, 10 where the column is trimmed to a specific weight/volume. The trimmed tobacco column 12 then passes under the left wheel 9 where it is scraped off the belt 5 by a scraper 11 as shown in FIG. 43D. At the same time, paper 13, which is pulled by a drive belt 14, is pulled under the trimmed tobacco column 12 by the rod forming section of the maker as shown in FIG. 43D.

The scraper 1, which is flat at it's entrance and concave at it's exit, forms the top of the tobacco column into a cylindrical shape, as shown in FIG. 43E. At the same time the paper 13 and drive belt 14 under the trimmed tobacco column 12 enter a garniture 15 that supports the drive belt 14 and paper 13. As the trimmed tobacco column 12 leaves the scraper 11 it passes under a tongue area 16 that maintains the cylindrical shape of the top of the trimmed tobacco column 12, as shown in FIG. 43F, As the trimmed tobacco column 12 travels through the tongue area 16 the drive belt 14 and paper 13 under the trimmed tobacco column 12 are formed by the garniture 15 around the trimmed tobacco column 12 to produce a cylindrical shape on the lower half of the column, as shown in FIG. 43F and FIG. 43G.

At this point the tobacco column has been transformed into a tobacco cylinder 20, as shown in FIG. 43H. Front and rear side rails/folders 17, 18 are attached to the garniture press on the drive belt 14 and keep the paper tight against the tobacco cylinder 20, as shown in FIG. 43G. As the tobacco cylinder 20 leaves the tongue 16 the rear folder 18 forces the drive belt 14 and paper 13 to wrap over the top of the tobacco cylinder 20, as shown in FIG. 43H. The tobacco cylinder 20 and paper 13 continue to travel down the garniture 15 and glue is applied by applicator 19 under the front edge of the paper, as shown in FIG. 43I. The front folder 17 then wraps the front edge of the paper 13 over the rear edge as the rear folder 18 releases the drive belt 14, as shown in FIG. 43J to FIG. 43L and provides a sealed tobacco rod 21.

However, there is a need in the art to provide a more efficient way than discussed above to provide a hollow passageway in the tobacco rod and a need for a method for producing a tobacco rod with a hollow passageway extending therethrough.

SUMMARY OF THE INVENTION

One embodiment of the present invention is a method for forming a hollow core tobacco rod comprising: feeding a trimmed tobacco column to a wheel; scraping the trimmed tobacco column from a porous drive belt; pulling paper under the trimmed tobacco with a drive belt, wherein sides of the trimmed tobacco column are contained between front and rear rails; widening and flattening the trimmed tobacco column against the paper; forming the paper into a cylindrical shape around the tobacco column with a garniture; passing tobacco column and paper under a tongue that further widens and flattens the tobacco column; forming the paper into a cylindrical shape; forming an inner hollow core with the tongue and a center mandrel; rolling the rear portion of the tobacco and paper into a cylindrical shape with the garniture and a rear folder; rolling the front of the trimmed tobacco column and paper into a vertical position with the garniture; applying glue to the inner edge of the paper with a glue applicator; forming the hollow core into a cylindrical shape with the center mandrel; rolling the tobacco and paper into a circular shape with a front folder; maintaining the hollow core shape with the center mandrel; releasing the rear of the drive belt from the rear folder; wrapping the front edge of the paper over the rear edge with the front folder; sealing the hollow core tobacco rod with glue from a glue applicator; and releasing the drive belt and lifting the sides of the belt into a vertical position; and outputting the sealed hollow core tobacco rod.

Another embodiment of the invention is an apparatus for forming a hollow core tobacco rod, comprising: a porous drive belt; a drive belt; a wheel; a scraper; a garniture; a tongue; a center mandrel; front and rear rails; front and rear folders, and a glue applicator. In the present embodiment, paper is pulled under a tobacco column with the drive belt; the scraper removes tobacco from the porous drive belt at the wheel, allows the tobacco column to widen, and begins to flatten the tobacco column against a paper; and the garniture forms the paper into a cylindrical shape around the tobacco column. Further, in this embodiment, the tongue widens and flatten the tobacco column and, with the center mandrel, forms an inner hollow core tobacco rod; the garniture and the rear folder roil a rear portion of the tobacco and paper into a cylindrical shape; the garniture rolls the front of the tobacco and paper into a vertical position where glue is applied to an inner edge of the paper by the glue applicator; and the center mandrel completes formation of the hollow core tobacco rod and maintains the shape of the hollow core tobacco rod. Furthermore, in this embodiment the front folder rolls the tobacco and paper into a circular shape; the rear folder releases a rear of the drive belt; the front folder wraps a front edge of the paper over a rear edge of the paper to seal the hollow core tobacco rod with glue from the glue applicator; and the front folder releases the drive belt further allowing the drive belt to lift into a vertical position allowing the sealed hollow core tobacco rod to exit the drive belt.

Another embodiment of the invention is a method for forming a hollow core tobacco rod with an inner web material to support the hollow core, comprising: feeding trimmed tobacco to a wheel; removing a leading edge of the trimmed tobacco with a scraper from a porous belt; pulling paper under the trimmed tobacco column with a drive belt, wherein sides of the trimmed tobacco column are contained by front and rear rails; widening and flattening the trimmed tobacco column against the paper with a scraper and tongue; feeding an inner core web material in at a matched speed matched to that of the trimmed tobacco column; forming the paper, tobacco, and inner web material into a cylindrical shape around a center folder; forming the inner hollow core with the center folder and the center mandrel; rolling a rear portion of the tobacco, paper, and inner web core material into a cylindrical shape; rolling the inner hollow core with a rear folder; rolling the front of the tobacco, paper, and inner web material into a vertical position with the garniture; applying glue to the inner edge of the paper with a glue applicator; forming the inner core with the center mandrel; rolling the tobacco, paper and inner web material into a cylindrical shape with the front folder; maintaining the hollow core shape with the center mandrel; releasing the rear of the drive belt with the rear folder; wrapping the front edge of the paper over the rear edge with the front folder; applying glue from the glue applicator; maintaining the shape of the hollow core with the center mandrel; releasing the drive belt from the front folder; lifting the sides of the drive belt into a vertical position; and outputting the sealed, hollow core tobacco rod, with inner core web material.

Another embodiment of the invention is an apparatus for forming a hollow core tobacco rod with an inner web material to support the hollow core, comprising: a porous drive belt; a drive belt; a wheel; a scraper; a garniture; a tongue; a center mandrel; front and rear rails; front and rear folders, and a glue applicator. In the present embodiment of the invention, paper is pulled under a tobacco column with the drive belt; the scraper removes tobacco from the porous drive belt at the wheel, allows the tobacco column to widen, and begins to flatten the tobacco column against a paper; the garniture forms the paper, tobacco, and an inner web material into a cylindrical shape around a center folder, wherein the inner core web material fed in at a matched speed; the tongue widens and flatten the tobacco column and, with the center mandrel, forms an inner hollow core tobacco rod. Further, in this embodiment the rear folder rolls a rear portion of the tobacco, paper, and inner web material into a cylindrical shape; the garniture rolls the front of the tobacco, paper, and inner web material into a vertical position where glue is applied to an inner edge of the paper by the glue applicator; the center mandrel completes formation of the hollow core tobacco rod and maintains the shape of the hollow core tobacco rod. Furthermore, in this embodiment the front folder rolls the tobacco, paper and inner web material into a cylindrical shape; the rear folder releases a rear of the drive belt; the front folder wraps a front edge of the paper over a rear edge of the paper to seal the hollow core tobacco rod with glue from the glue applicator; and the front folder releases the drive belt further allowing the drive belt to lift into a vertical position allowing the sealed hollow core tobacco rod with inner core material to exit the drive belt.

Yet another embodiment of the invention is a method for forming a hollow core tobacco rod using extra wide paper to support the inner core, comprising: feeding a trimmed tobacco column to a wheel; removing trimmed tobacco column from the porous belt with the leading edge of a scraper; pulling an extra wide web of paper under the trimmed tobacco column with a drive belt and sides of the tobacco column being contained by front and rear rails; widening and flattening the trimmed tobacco column against the paper with the scraper and tongue; rolling the paper over the trimmed tobacco column; wrapping the paper over the front edge of the trimmed tobacco column; forming the tobacco and paper into a cylindrical shape around the tongue with the garniture; forming the tobacco and paper into a hollow core with a rear folder and center mandrel; rolling the tobacco and paper into a vertical position; applying glue to the inner edge of the paper with a glue applicator; rolling the tobacco and paper into a cylindrical shape; maintaining the hollow core shape with the center mandrel; releasing the rear of the drive belt from the rear folder; wrapping the front edge of the paper over the rear edge with the front folder; sealing the tobacco rod with glue from the glue applicator; releasing the drive belt and lifting the edges of the drive belt into a vertical position; and outputting the sealed, hollow core tobacco rod.

Yet another embodiment of the invention is an apparatus for forming a hollow core tobacco rod using extra wide paper to support the inner core, comprising: a porous drive belt; a drive belt; a wheel; a scraper; a garniture; a tongue; a center mandrel; a folder; front and rear rails; front and rear folders, and a glue applicator. In the present embodiment of the invention, an extra wide web of paper is pulled under the tobacco column by the drive belt; the sides of the tobacco column are contained by the front rail and rear rail; the scraper and the tongue allow the tobacco column to widen and flatten against the extra wide paper; and the folder rolls the paper over the tobacco column. Further, in this embodiment the folder wraps the paper over the tobacco column and a front edge of the tobacco column is contained by the front rail; the garniture forms the extra wide paper and tobacco into a cylindrical shape around a center folder; the tongue widens and flatten the tobacco column and, with the center mandrel, forms an inner hollow core tobacco rod. Furthermore, in this embodiment the garniture rolls the front of the tobacco and paper into a vertical position where glue is applied to an inner edge of the paper by the glue applicator; the center mandrel completes formation of the hollow core tobacco rod and maintains the shape of the hollow core tobacco rod; the front folder rolls the tobacco, paper and inner web material into a cylindrical shape; the rear folder releases a rear of the drive belt; the front folder wraps a front edge of the paper over a rear edge of the paper to seal the hollow core tobacco rod with glue from the glue applicator; and the front folder releases the drive belt further allowing the drive belt to lift into a vertical position allowing the sealed hollow core tobacco rod with inner core material to exit the drive belt.

DETAILED DESCRIPTION OF THE PREFERRED EMBODIMENT

One embodiment of the present invention is a method for forming a hollow core tobacco rod. In particular, FIG. 1A shows an exemplary flow diagram of a method for forming a hollow core tobacco rod for this embodiment and FIG. 1B shows an embodiment of an apparatus of the present invention.

Figure 1A:
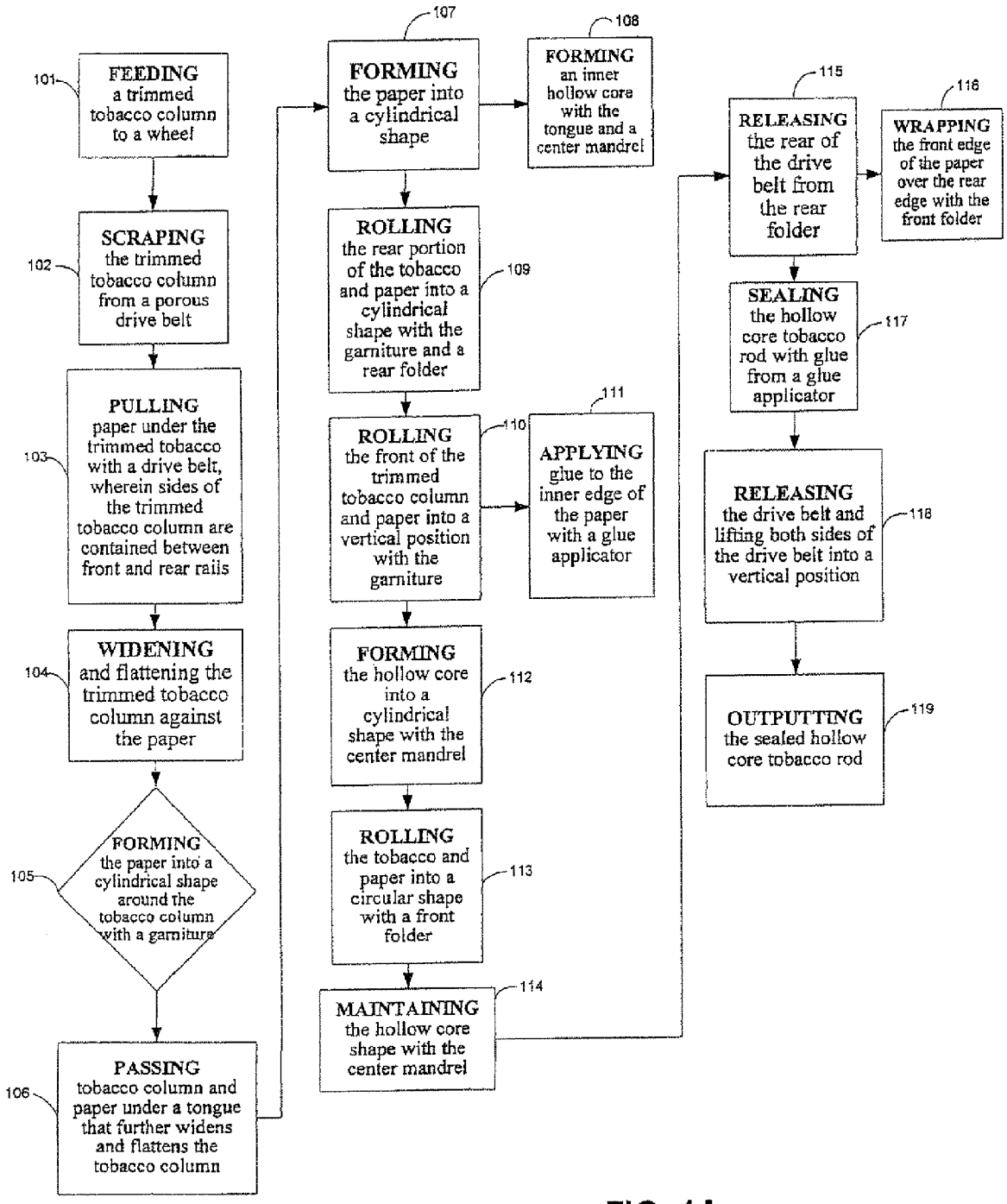
FIG. 1A shows an exemplary flow diagram of a method for forming a hollow core tobacco rod for a first embodiment of the present invention.
Figure 1B:
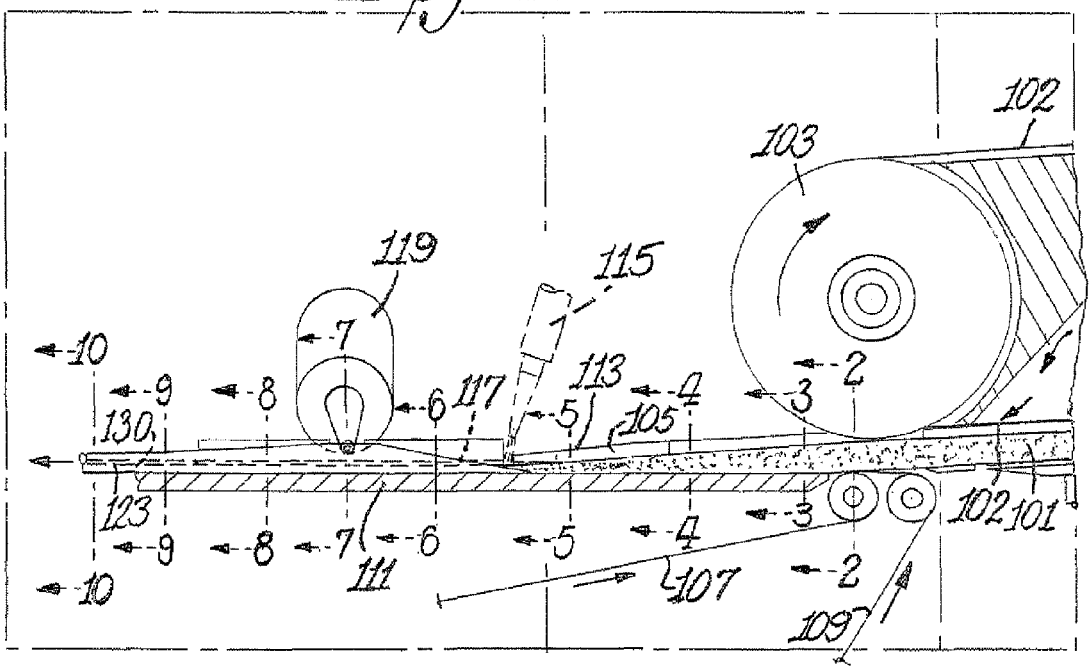
FIG. 1B shows an exemplary diagram of an embodiment of the present invention.

As shown in FIG. 1A, step 101 is directed to feeding a trimmed tobacco column to a wheel. Scraping the trimmed tobacco column from a porous drive belt occurs in step 102. Step 103 of FIG. 1A is pulling paper under the trimmed tobacco with a drive belt, wherein sides of the trimmed tobacco column are contained between the front and rear rails. Step 104 involves widening and flattening the trimmed tobacco column against a paper. Forming the paper into a cylindrical shape around the tobacco column with a garniture is performed in step 105.

Step 106 involves passing the tobacco column and paper under a tongue that further widens and flattens the tobacco column. Forming the paper into a cylindrical shape occurs and forming an inner hollow core with the tongue and center mandrel occur in step 107 and step 108, respectively. Step 109 involves rolling a rear portion of the tobacco and paper into a cylindrical shape with the garniture and a rear folder. Rolling the front of the trimmed tobacco column and paper into a vertical position with the garniture and applying glue to the inner edge of the paper with a glue applicator occur in step 110 and step 111, respectively.

In step 112, the hollow core is formed into a cylindrical shape with the center mandrel. Rolling the tobacco and paper into a circular shape with a front folder occurs in step 113. In step 114, the hollow core maintains the shape with the center mandrel. Releasing the rear of the drive belt from the rear folder occurs and wrapping the front edge of the paper over the rear edge with the front folder occurs in step 115 and step 116, respectively. In step 117, the hollow core tobacco rod is sealed with glue from a glue applicator. Releasing the drive belt and lifting both sides of the drive belt into a vertical position occurs in step 118. In step 119, the sealed hollow core tobacco rod is output from the apparatus of the present invention.

Figure 2:
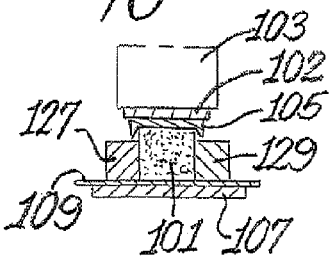
FIG. 2 shows how the trimmed tobacco column travels to the wheel where the leading edge of a scraper removes the tobacco from the porous belt.
Figure 3:
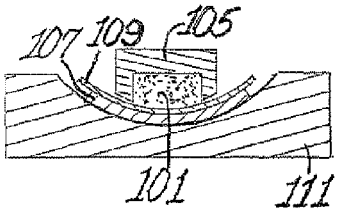
FIG. 3 shows how the tobacco column and paper travels and how the scraper allows the tobacco column to widen and begins to flatten the tobacco column against the paper.
Figure 4:
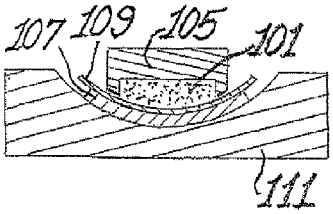
FIG. 4 shows how the garniture begins forming the paper into a cylindrical shape around the tobacco column.
Figure 5:
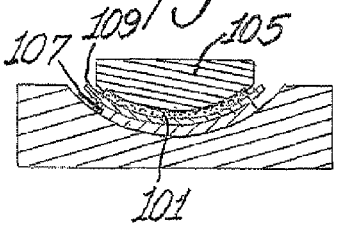
FIG. 5 shows how the tobacco column and paper pass under a tongue that continues to widen and flatten the tobacco column.

As shown in FIG. 1B, the trimmed tobacco column 101 travels to the wheel 103. At this point, the leading edge of a scraper 105 removes the tobacco from the porous drive belt 102, as shown in FIG. 2. Paper 109 is pulled under the tobacco column 101 by a drive belt 107 and the sides of the tobacco column 101 are contained by front and rear rails (not shown). As the tobacco column 101 and paper 109 travels to the left, the scraper 105 allows the tobacco column 101 to widen and begins to flatten the tobacco column 101 against the paper 109, as shown in FIG. 3 and FIG. 4. At the same time the garniture 111 begins forming the paper into a cylindrical shape around the tobacco column 101, as shown in FIG. 3 and FIG. 4. The tobacco column 101 and paper 109 then pass under a tongue 113 that continues to widen and flatten the tobacco column 101. The garniture 111 continues to form the paper into a cylindrical shape, as shown in FIG. 5. The shape of the tongue 113 then blends into a center mandrel 117 and begins forming the inner hollow core of tobacco.

Figure 6:
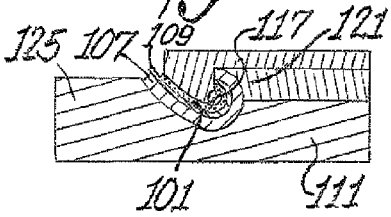
FIG. 6 shows how the garniture and a rear folder roll the rear portion of the tobacco and paper into a cylindrical shape.
Figure 7:
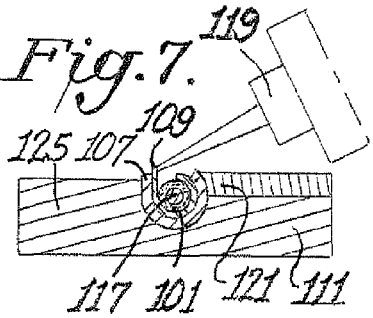
FIG. 7 shows how the garniture rolls the front of the tobacco and paper into a vertical position where glue is applied to the inner edge of the paper by the glue applicator.
Figure 8:
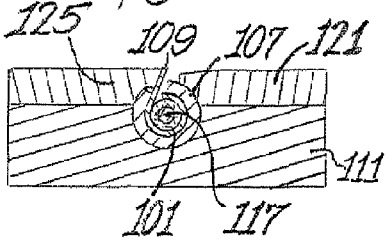
FIG. 8 shows how the tobacco and paper continue to travel and how a front folder rolls the tobacco and paper into a circular shape and that the center mandrel maintains the hollow core shape.

At the same time the garniture 111 and a rear folder 121 roll the rear portion of the tobacco and paper into a cylindrical shape, as shown in FIG. 6. As shown in FIG. 7, the garniture 111 rolls the front of the tobacco 101 and paper 109 into a vertical position where glue is applied to the inner edge of the paper by the glue applicator 119. The center mandrel 117 of FIG. 1B and FIG. 7 is cylindrical at this point and completes the formation of the hollow core. As the tobacco 101 and paper 109 continue to travel to the left, a front folder 125 continues to roll the tobacco 101 and paper 109 into a circular shape and the center mandrel 117 maintains the hollow core shape, as shown in FIG. 8.

Figure 9:
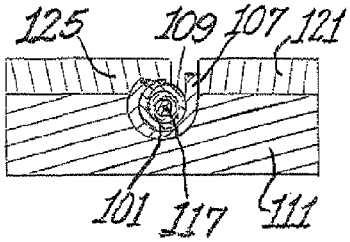
FIG. 9 shows the rear folder releasing the rear of the drive belt and the front folder wrapping the front edge of the paper over the rear edge where it is sealed by the glue from the glue applicator.
Figure 10:
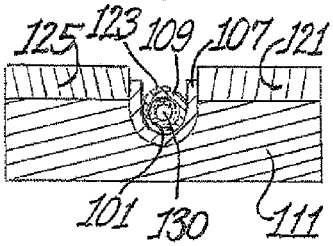
FIG. 10 shows the front folder releasing the drive belt and allowing the belt to lift into a vertical position so that the sealed hollow core tobacco rod can be output from the apparatus of the present invention.

FIG. 9 shows that the rear folder 121 then releases the rear of the drive belt 107 and the front folder 125 wraps the front edge of the paper 109 over the rear edge where it is sealed by the glue from the glue applicator 119. During this operation the center mandrel 117 still maintains the shape of the hollow core. The front folder 125 then releases the drive belt 107 and allows the belt to lift into a vertical position so that the sealed hollow core tobacco rod 123 can exit the belt as shown in FIG. 10

As an option in the embodiment discussed above, a binder material can be applied through device 115 to the tobacco 101 as it is being formed into a wide flat column, as shown in FIG. 1B. This binder material increases the rigidity of the hollow core.

Another embodiment of the present invention is a method for forming a hollow core tobacco rod with an inner web material to support the hollow core. In particular, FIG. 11A shows an exemplary flow diagram of the method for forming a hollow core tobacco rod with the inner hollow core supported by a web material and FIG. 11B shows another exemplary embodiment of the apparatus of the present invention.

Figure 11A:
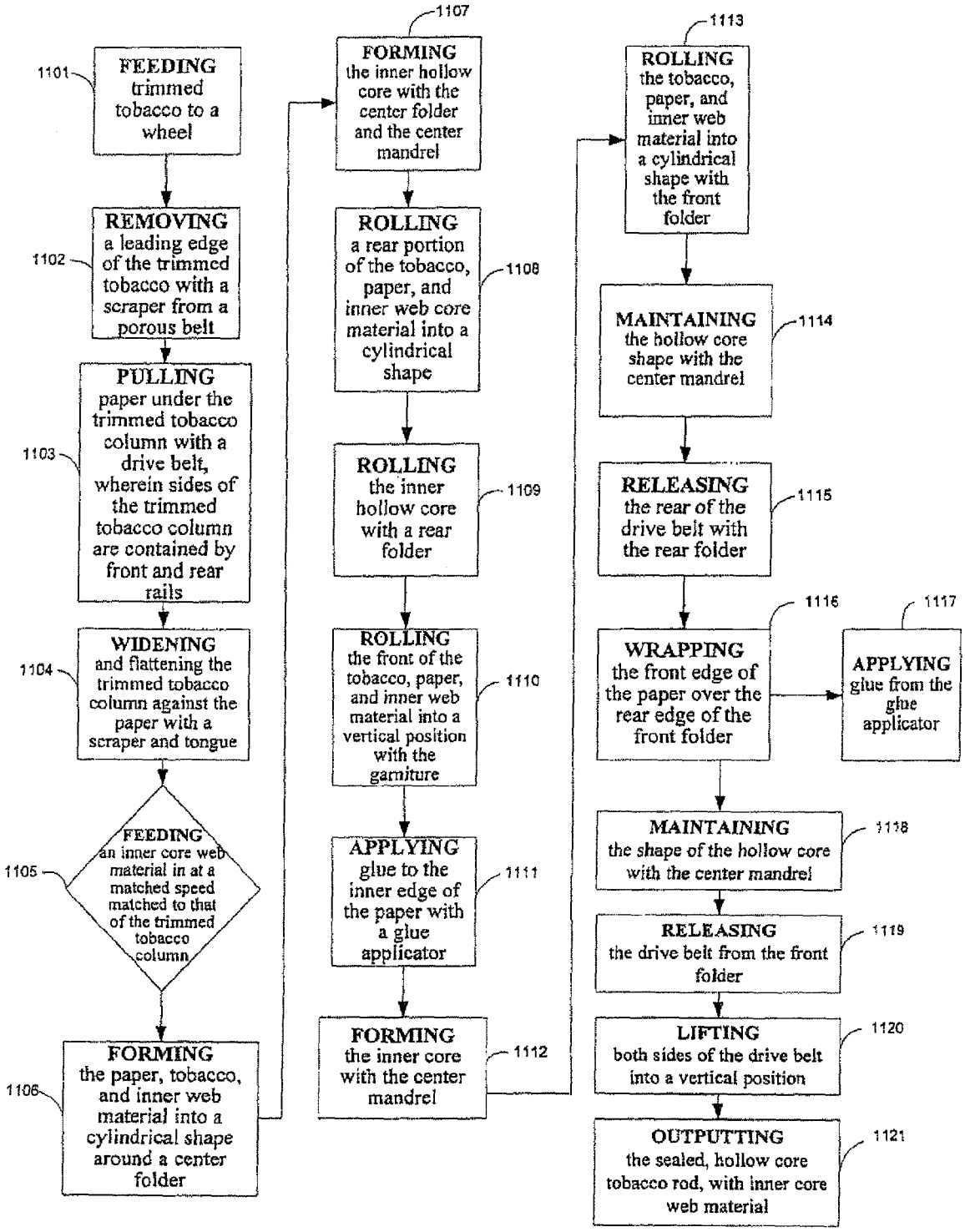
FIG. 11A shows an exemplary flow diagram of a method for forming a hollow core tobacco rod with the inner hollow core supported by a web material.
Figure 11B:
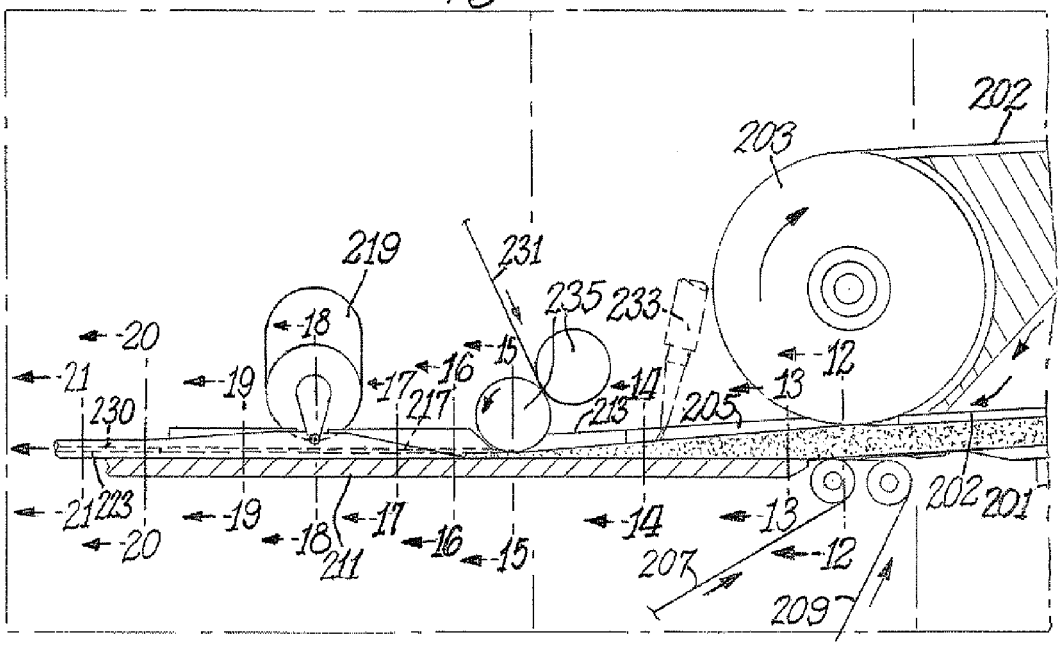
FIG. 11B shows an exemplary diagram of another embodiment of the present invention.

As shown in FIG. 11A, step 1101 is directed to feeding a trimmed tobacco column to a wheel. Removing a leading edge of the trimmed tobacco column with a scraper from a porous drive belt occurs in step 1102. Step 1103 of FIG. 11A is pulling paper under the trimmed tobacco column with a drive belt, wherein sides of the trimmed tobacco column are contained between the front and rear rails. Step 1104 involves widening and flattening the trimmed tobacco column against a paper with a scraper and tongue. Feeding an inner core web material at a speed matched to that of the trimmed tobacco column occurs in step 1105. In step 1106, the paper, tobacco, and inner web material are formed into a cylindrical shape around a center folder. Step 1107 involves forming the inner hollow core with the center folder and the center mandrel. Step 1108 involves rolling a rear portion of the tobacco, paper and inner web core material into a cylindrical shape. Rolling the inner hollow core with a rear folder occurs in step 1109. Rolling the front of the tobacco, paper and inner web material into a vertical position with the garniture and applying glue to the inner edge of the paper with a glue applicator occur in step 1110 and step 1111, respectively.

In step 1112, the inner core is formed with the center mandrel. Rolling the tobacco, paper and inner web material into a cylindrical shape into with the front folder occurs in step 1113. In step 1114, the hollow core maintains the shape with the center mandrel. Releasing the rear of the drive belt from the rear folder occurs and wrapping the front edge of the paper over the rear edge of the front folder occurs in step 1115 and step 1116, respectively, In step 1117, the tobacco rod is sealed with glue from a glue applicator. Step 1118 involves maintaining the shape of the hollow core with the center mandrel. Releasing the drive belt from the front folder and lifting both sides of the drive belt into a vertical position occurs in step 1119 and step 1120, respectively. In step 1121, the sealed hollow core tobacco rod with inner core web material is output from the apparatus of the present invention.

As an option for the embodiment discussed above, a binder material can be applied to the tobacco through device 233 as it is being formed into a wide and flat column. This binder material increases the rigidity of the hollow core.

Yet another embodiment of the present invention is a method for forming a hollow core tobacco rod using extra wide paper to support the inner core. In particular, FIG. 22A shows an exemplary flow diagram of a method for forming a hollow core tobacco rod with extra wide paper to support the inner hollow core and the outer diameter of the rod and FIG. 22B shows yet another exemplary embodiment of the apparatus of the present invention.

Figure 22A:
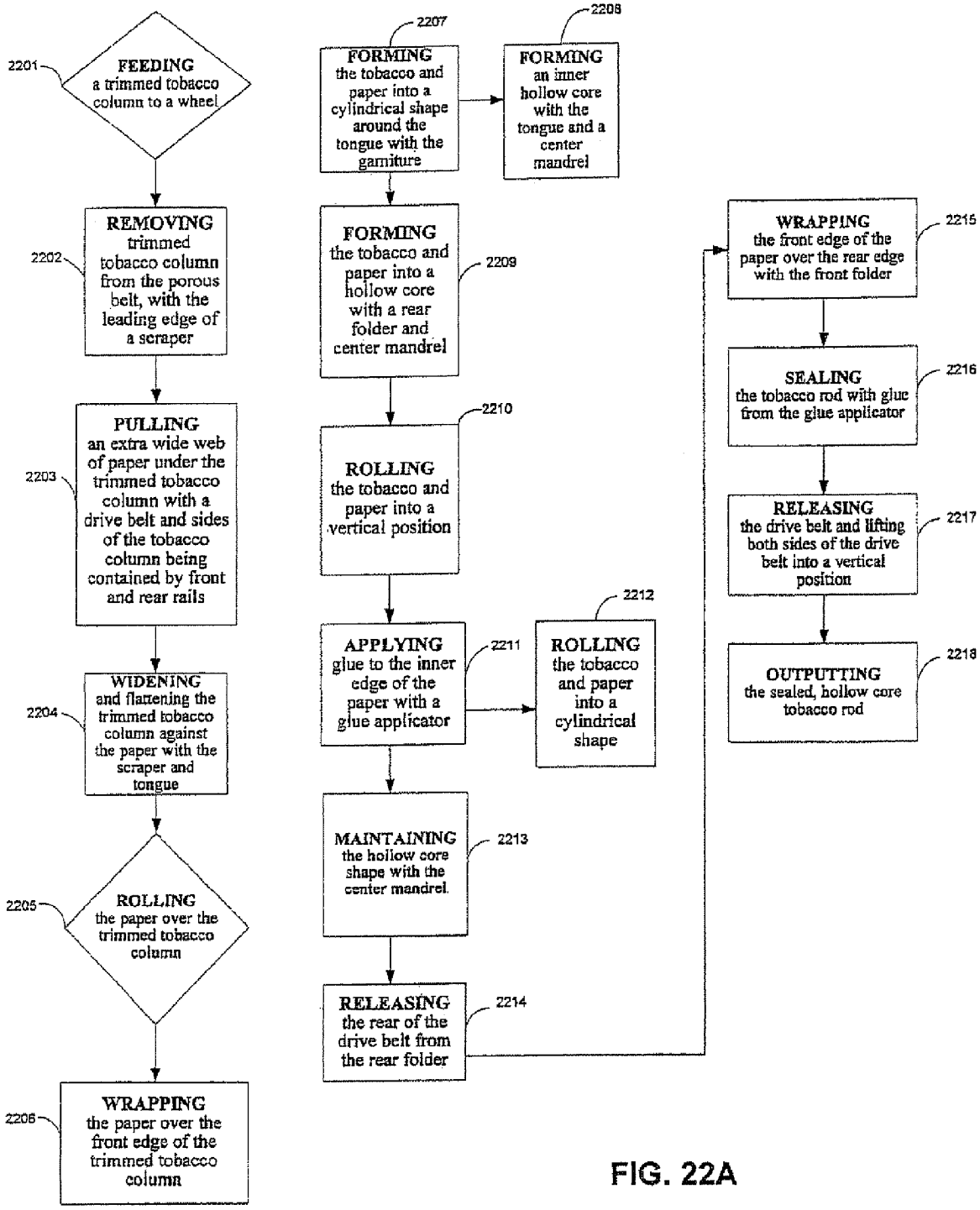
FIG. 22A shows an exemplary flow diagram of a method for forming a hollow core tobacco rod with extra wide paper to support the inner hollow core and the outer diameter of the rod.
Figure 22B:
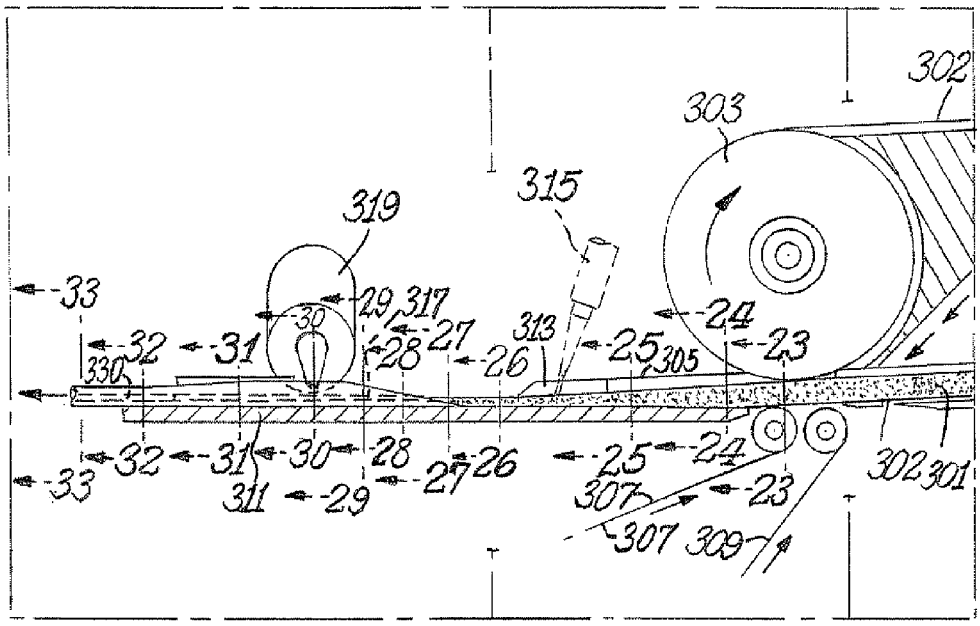
FIG. 22B shows an exemplary diagram of yet another embodiment of the present invention.

As shown in FIG. 22A, step 2201 is directed to feeding a trimmed tobacco column to a wheel. Removing the trimmed tobacco column from a porous drive belt with a leading edge of a scraper occurs in step 2202. Step 2203 of FIG. 22A is pulling an extra wide web of paper under the trimmed tobacco column with a drive belt and sides of the trimmed tobacco column being contained by the front and rear rails. Step 2204 involves widening and flattening the trimmed tobacco column against the paper with the scraper and tongue. Rolling the paper over the trimmed tobacco column is performed in step 2205.

Step 2206 involves wrapping the paper over the front edge of the trimmed tobacco column. Forming the tobacco and paper into a cylindrical shape around the tongue with a garniture and forming an inner hollow core with the tongue and a center mandrel occurs in step 2207 and step 2208, respectively. Step 2209 involves forming the tobacco and paper into a hollow core with a rear folder and center mandrel. Rolling the tobacco and paper into a vertical position and applying glue to the inner edge of the paper with a glue applicator occur in step 2210 and step 2211, respectively.

In step 2212, the tobacco and paper are rolled into a cylindrical shape. In step 2213, the hollow core maintains the shape with the center mandrel. Releasing the rear of the drive belt from the rear folder occurs and wrapping the front edge of the paper over the rear edge with the front folder occurs in step 2214 and step 2215, respectively. In step 2216, the hollow core tobacco rod is sealed with glue from a glue applicator. Releasing the drive belt and lifting both sides of the drive belt into a vertical position occurs in step 2217. In step 2219, the sealed hollow core tobacco rod is output from the apparatus of the present invention.

Figure 23:
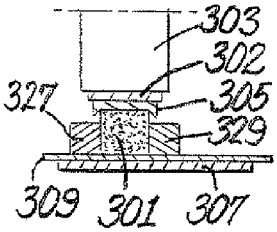
FIG. 23 shows how the trimmed tobacco column travels to the wheel where the leading edge of a scraper removes the tobacco from the porous belt.
Figure 24:
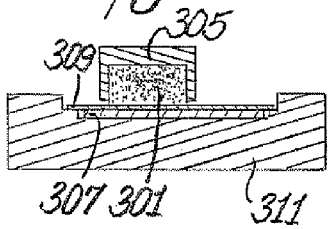
FIG. 24 shows how the tobacco and paper travel.
Figure 25:
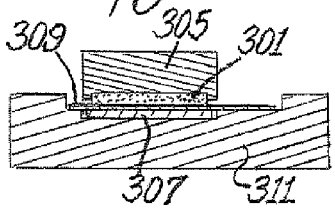
FIG. 25 shows how the scraper and tongue allow the tobacco column to widen and flatten against the paper.
Figure 26:
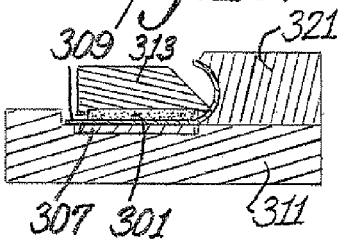
FIG. 26 shows how the folder begins rolling the paper over the tobacco column.
Figure 27:
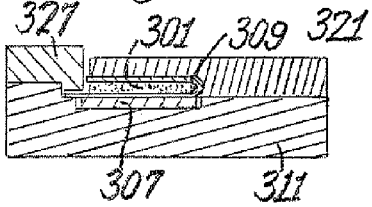
FIG. 27 shows how the folder has completely wrapped the paper over the tobacco column and how the front edge of the tobacco column is contained by the front rail.
Figure 28:
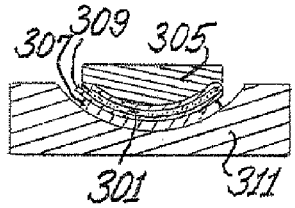
FIG. 28 shows how the tobacco and paper travels to the garniture and begins forming the tobacco and paper into a cylindrical shape around the tongue.

In FIG. 22B, the trimmed tobacco column 301 travels to the wheel 303 where the leading edge of a scraper 305 removes the tobacco from the porous belt 302, as shown in FIG. 23. An extra wide web of paper 309 is pulled under the tobacco column 301 by a drive belt 307 and the sides of the tobacco column 301 are contained by front rail 327 and rear rail 329, as shown in FIG. 23. As the tobacco 301 and paper 309 travels to the left, the scraper 305 and tongue 313 allow the tobacco column 301 to widen and flatten against the paper 309, as shown in FIG. 24-FIG. 26. FIG. 26 shows Folder 321 begins rolling the paper 309 over the tobacco column 301. Folder 321 has completely wrapped the paper 309 over the tobacco column 301 and the front edge of the tobacco column 301 is contained by the front rail 327, as shown in FIG. 27. As the tobacco 301 and paper 309 travels to the left, the garniture 311 begins forming the tobacco 301 and paper 309 into a cylindrical shape around the tongue 305, as shown in FIG. 28.

Figure 29:
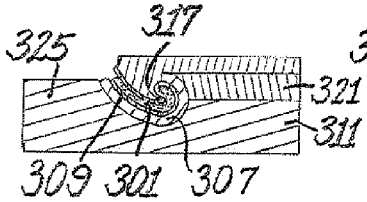
FIG. 29 shows a cylindrical shaped center mandrel, where the hollow core begins to form.
Figure 30:
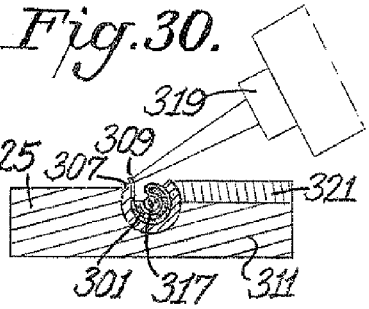
FIG. 30 shows how the garniture rolls the tobacco and paper into a vertical position where glue is applied to the inner edge of the paper by a glue applicator.
Figure 31:
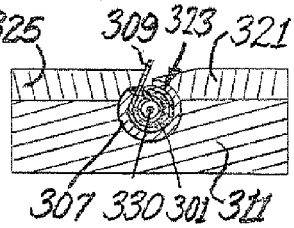
FIG. 31 shows how the tobacco and paper continue to a front folder that rolls the tobacco and paper into a cylindrical shape.
Figure 32:
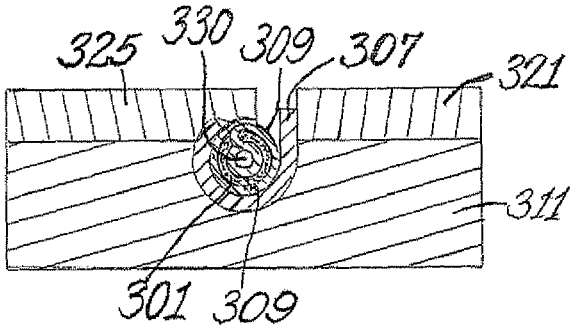
FIG. 32 shows how the rear folder releases the rear of the drive belt and the front folder wraps the front edge of the paper over the rear edge where it is sealed by the glue from the glue applicator.
Figure 33:
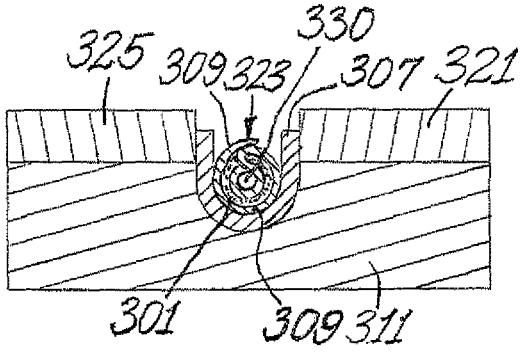
FIG. 33 shows the release of the drive belt that allows the belt to lift into a vertical position so that the sealed, hollow core tobacco rod can exit be output from the present invention.

The tobacco 301 and paper 309 then travel to a rear folder 321. The shape of the tongue 305 as shown in FIG. 28 changes into a cylindrical shaped center mandrel, also specified as item 317, where the hollow core begins to form, as shown in FIG. 29. FIG. 30 shows the garniture 311 rolls the tobacco 301 and paper 309 into a vertical position where glue is applied to the inner edge of the paper by a glue applicator 319, as shown in FIG. 30. As the tobacco 301 and paper 309 continue to the left a front folder 325 rolls the tobacco 301 and paper 309 into a cylindrical shape and the center mandrel 317 maintains the hollow core shape, as shown in FIG. 31. The rear folder 321 then releases the rear of the drive belt 307 and the front folder 325 wraps the front edge of the paper 309 over the rear edge where it is sealed by the glue from the glue applicator 319. During this operation the center mandrel 317 still maintains the shape of the hollow core. The front folder 325 then releases the drive belt 307 and allows the belt to lift into a vertical position so that the sealed, hollow core tobacco rod 323 can exit the belt 307, as shown in FIG. 33.

Figure 12:
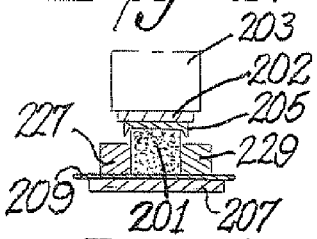
FIG. 12 shows how the trimmed tobacco column travels to the wheel where the leading edge of a scraper removes the tobacco from the porous belt.
Figure 13:
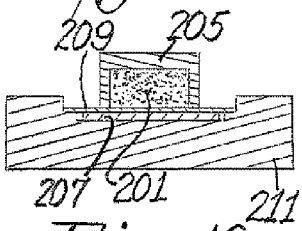
FIG. 13 shows the tobacco and paper as they travel to the scraper and tongue.
Figure 14:
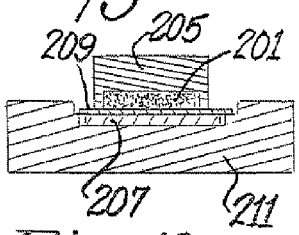
FIG. 14 shows how the scraper and tongue which allow the tobacco column to widen and flatten against the paper.

The trimmed tobacco column 201 of FIG. 11B travels to the wheel 203 where the leading edge of a scraper 205 removes the tobacco 201 from the porous belt 202, as shown FIG. 12. Paper 209 is pulled under the tobacco column 201 by a drive belt 207 and the sides of the tobacco column 201 are contained by front and rear rails 227 and 229, as shown in FIG. 12. As the tobacco and paper travel to the left, the scraper 205 and tongue 213 allow the tobacco column 201 to widen and flatten against the paper 209, as shown in FIG. 13 and FIG. 14.

Figure 15:
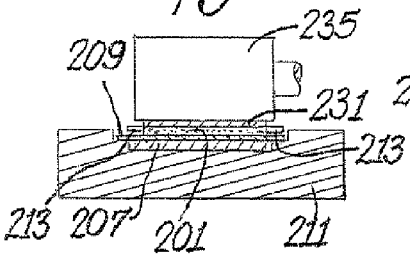
FIG. 15 shows an inner core web material.
Figure 16:
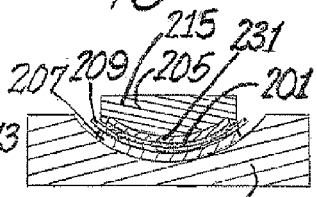
FIG. 16 shows how the tobacco travels to the garniture which begins forming the paper, tobacco, and inner web material into a cylindrical shape.

FIG. 15 shows that an inner core web material 231 is also fed in at a matched speed. As the tobacco travels to the left, the garniture begins forming the paper, tobacco, and inner web material into a cylindrical shape around a center folder. The garniture 211 continues to form the paper into a cylindrical shape, as shown in FIG. 16.

Figure 18:
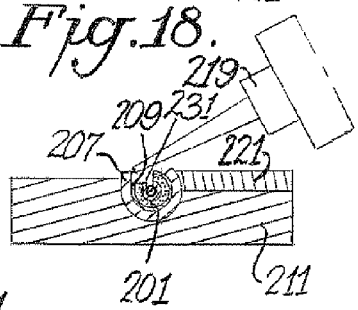
FIG. 18 shows the garniture rolling the front of the tobacco, paper, and inner web material into a vertical position where glue is applied to the inner edge of the paper by a glue applicator.
Figure 17:
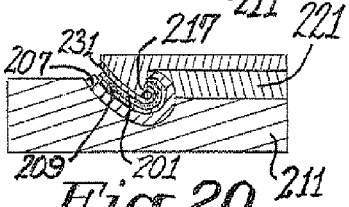
FIG. 17 shows how the center folder begins forming the inner hollow core.

As shown in FIG. 17, the center folder and center mandrel 217 begin forming the inner hollow core. At the same time, a rear folder 221 rolls the rear portion of the tobacco 201, paper 209, and inner web material 231 into a cylindrical shape, as shown in FIG. 18. FIG. 18 also shows the garniture 211 rolling the front of the tobacco 201, paper 209, and inner web material 231 into a vertical position where glue is applied to the inner edge of the paper 209 by a glue applicator 219.

Figure 19:
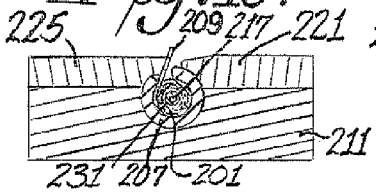
FIG. 19 shows how the center mandrel completes the formation of the inner core.
Figure 20:
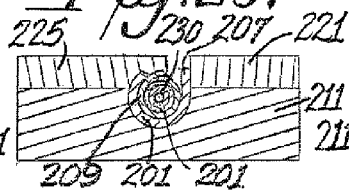
FIG. 20 shows how the rear folder releases the rear of the drive belt and the front folder wraps the front edge of the paper over the rear edge where it is sealed by glue from the glue applicator.

The center mandrel 217 is cylindrical at this point and completes the formation of the inner core, as shown in FIG. 19. As the tobacco 201, paper 209, and inner web material 231 continue to travel to the left, a front folder 225 continues to roll the tobacco 201, paper 209, and inner web material 231 into a cylindrical shape and the center mandrel 217 maintains the hollow core shape, as shown in FIG. 19. FIG. 20 shows how the rear folder 221 then releases the rear of the drive belt 207 and the front folder 225 wraps the front edge of the paper 209 over the rear edge where it is sealed by glue from the glue applicator 219. During this operation the center mandrel 217 still maintains the shape of the hollow core.

Figure 21:
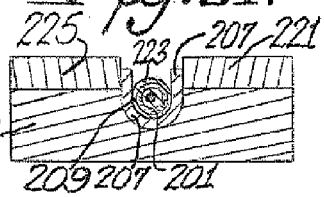
FIG. 21 shows how the front folder then releases the drive belt and allows the belt to lift into a vertical position so that the sealed, hollow core tobacco rod, with inner core web material is output from the present invention.

FIG. 21 shows how the front folder 225 then releases the drive belt 207 and allows the belt to lift into a vertical position so that the sealed, hollow core tobacco rod 223, with inner core web material 231, can exit the belt.

As an option for the embodiment discussed above, a binder material can be applied through device 315 to the tobacco 301 as it is being formed into a wide and flat column. This binder material increases the rigidity of the hollow core.

Figure 34:
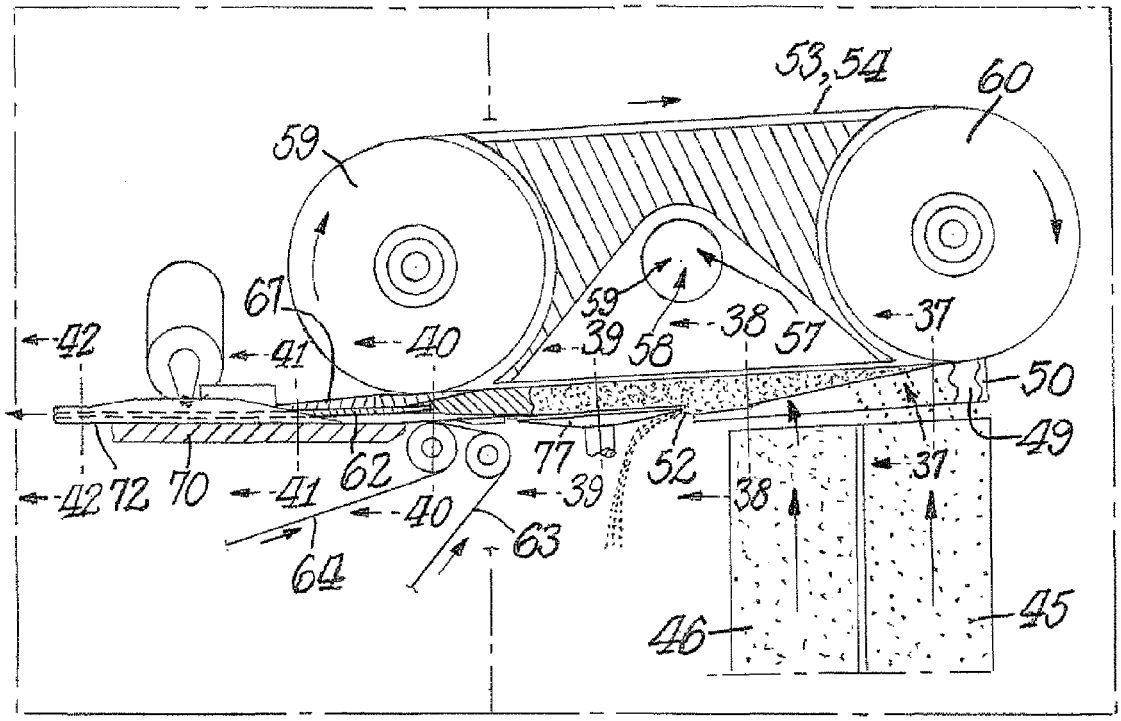
FIG. 34 shows yet another embodiment of the present invention.

FIG. 34 shows yet another embodiment of the present invention that implements what will be referred to as the mandrel method. In FIG. 34, a rod 62 is added to the end of the center rail 49. The rod 62 extends into the tobacco flow between the tongue 67 and the garniture 70. The rod 62 serves as a mandrel, about which the tobacco flows between the tongue 67 and the garniture 70. In addition, tobacco gathers around the rod/mandrel 62 and is formed into a cylindrical shape by the garniture 70 and the tongue 67. The rod/mandrel 62 is typically sealed and cylindrical in shape. As the tobacco leaves the rod/mandrel 62, a hole remains in the tobacco cylinder.

FIG. 34 also includes a center rail 49, rear rail 50 and front rail 48 (not shown) that enclose trimmed tobacco columns 51, 52. Porous belts 53, 54 are located below a wheel 59. Also shown in the FIG. 34 are the rod/mandrel 62, paper 63 and porous drive belts 53, 54, each of which interface to a wheel 59, 60. Further FIG. 34 shows a glue applicator 41, folders and a spinning trimming disk 77. Furthermore, FIG. 34 shows a tobacco feed flows with a right updraft 45 and left updraft 46 conductive chambers; and porous belts 53, 54 that allow air flows, as indicated by arrows 57, 58, and 59, The details of sections 37 to 42 of FIG. 34 shown in detail in FIG. 37 to FIG. 42, respectively.

Figure 35:
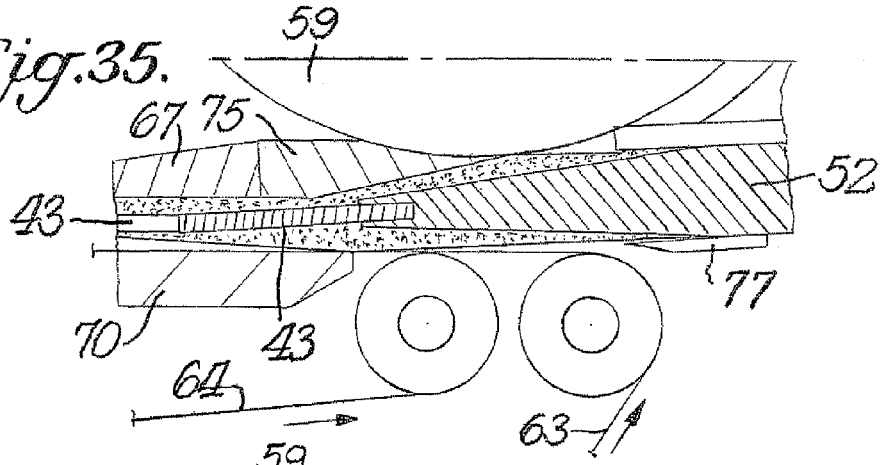
FIG. 35 shows an enlarged view of FIG. 34 with a solid cylindrical mandrel inserted in the center rail.

FIG. 35 shows an enlarged view of a solid cylindrical mandrel 62 inserted in the center rail 49. Also shown in FIG. 35 are the wheel 59, tongue 67, garniture 70, scraper 75, drive belt 64 and paper 63. The solid cylindrical mandrel 62 produces a hollow core in the tobacco that is output from the apparatus as indicated at reference 43.

As a variation on the apparatus and method shown in FIG. 35 and discussed above, the solid cylindrical mandrel 62 on the end of the center rail could be replaced by a hollow metal tube 43 to serve as the mandrel. The end of the tube, located between the tongue 67 and the garniture 70, would be sealed and holes would be added around the periphery of the hollow metal tube 43 in the area where the tobacco contacts the tube. A binder material could be pumped through the hollow metal tube and into the tobacco where it contacts the outer diameter of the hollow metal tube 43. This binder material would harden as the tobacco leaves the mandrel leaving a higher strength center hole in the cylindrical tobacco rod.

Figure 36:
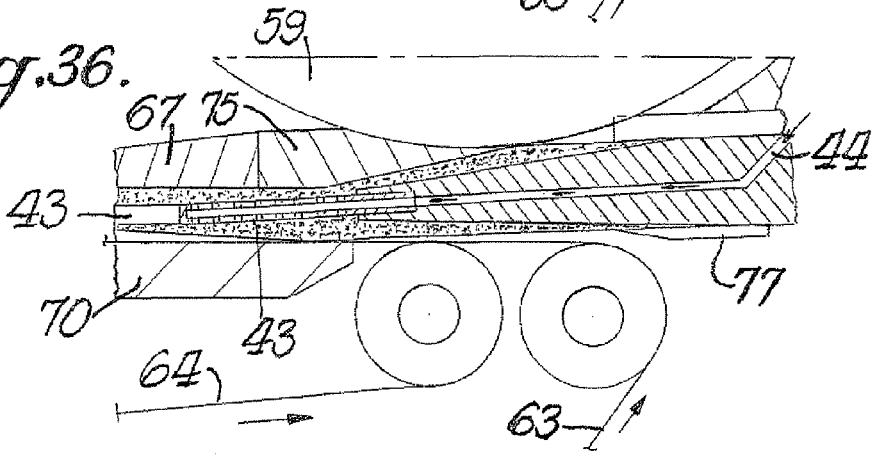
FIG. 36 shows an enlarged view of FIG. 34 with a hollow tube mandrel inserted in the center rail.

FIG. 36 shows an enlarged view of the hollow tube mandrel 43 discussed above. With this mandrel approach, denser tobacco areas can be formed by making pockets deep enough on the trimmed tobacco 52 with the rotating trimming disk 77 to allow the extra tobacco to crush the hollow center of the tobacco in certain areas. The direction of binder material flow is indicated by the arrow 44 which continues to flow through the hollow tube mandrel 43 providing binder material feed-through.

Figure 37:
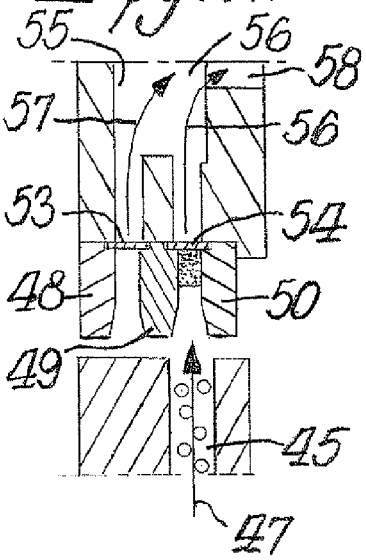
FIG. 37 shows a tobacco feed flow with a right updraft.
Figure 38:
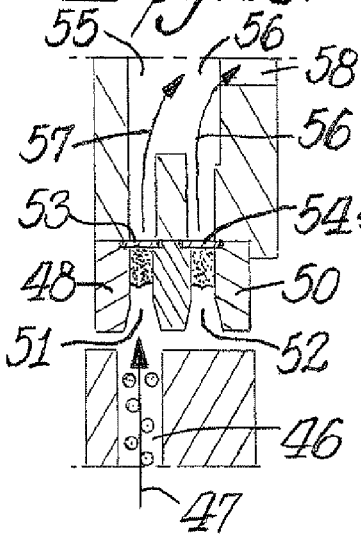
FIG. 38 show a tobacco feed flow with a left updraft.

FIG. 37 and FIG. 38 show a tobacco feed flow 47 with right updraft 45 and left updraft 46 conductive chambers. A front rail 48, center rail 49 and rear rail 50 enclose tobacco columns 51, 52. Porous belts 53, 54 are located at the bottom of vacuum chambers 55, 56 that allow air flows, as indicated by arrows 57, 58.

Figure 39:
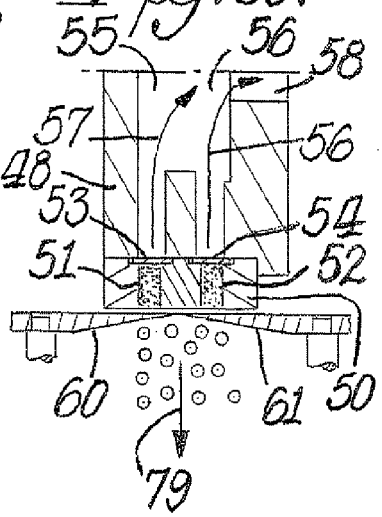
FIG. 39 shows the present invention where the tobacco columns are trimmed.

FIG. 39 shows the present invention where the tobacco columns 51, 52 are trimmed. Tobacco flow 79 and air flows 57, 58 are indicated by the designated arrows. A front rail 48, center rail 49 and rear rail 50 enclose the trimmed tobacco columns 51, 52. Porous belts 53, 54 are located at the bottom of vacuum chambers 55, 56 and allow air flows, as indicated by arrows 57, 58. Also shown in the FIG. 39 are a front disk 60 and a rear disk 61.

Figure 40:
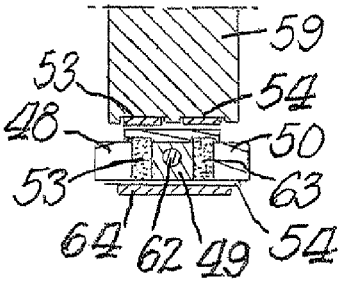
FIG. 40 shows the present embodiment of the invention that utilizes a wheel.

FIG. 40 shows the present embodiment of the invention that utilizes a wheel 59, In addition, FIG. 40 shows a front rail 48, center rail 49 and rear rail 50 enclose the trimmed tobacco columns 51, 52. Porous belts 53, 54 are located below the wheel 59. Also shown in the FIG. 40 are a solid mandrel center rail 62, paper 63 and a drive belt 64 each of which is located below the wheel 59.

Figure 41:
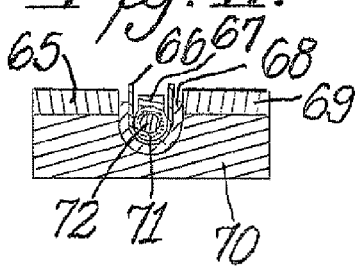
FIG. 41 shows a tobacco rod with a solid center mandrel.

FIG. 41 shows a tobacco rod 71 with a solid center mandrel 72. In particular, FIG. 41 shows a front folder 65, rear folder 69 resting on top of a garniture 70. FIG. 41 also shows the paper 63, tongue 67, drive belt 68 all positioned within the garniture 70.

Figure 42:
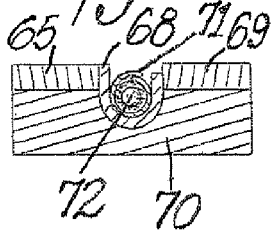
FIG. 42 shows a tobacco rod with a hollow center mandrel.
Figure 43:
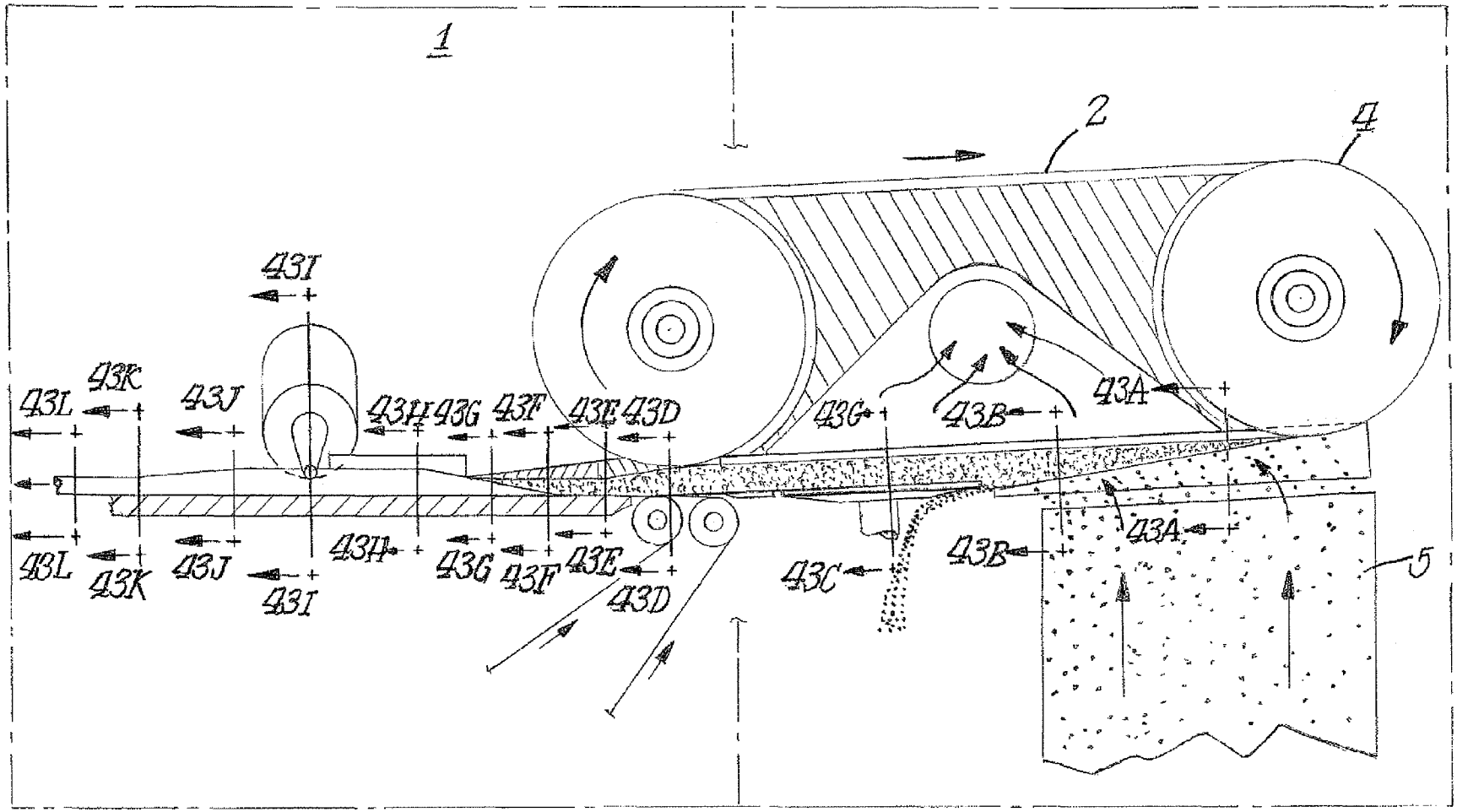
FIG. 43 shows an embodiment of the background art.
Figure 43A:
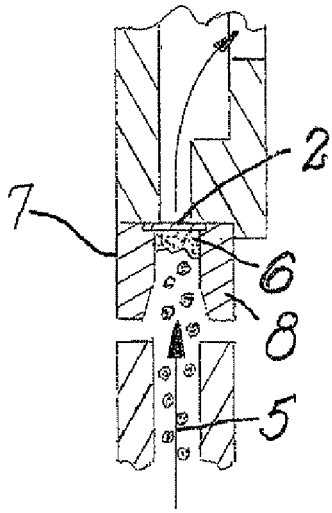
FIG. 43A shows a section 43A-43A of FIG. 43.
Figure 43B:
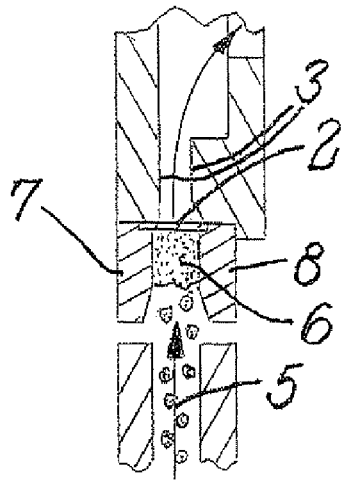
FIG. 43B shows a section 43B-43B of FIG. 43.
Figure 43C:
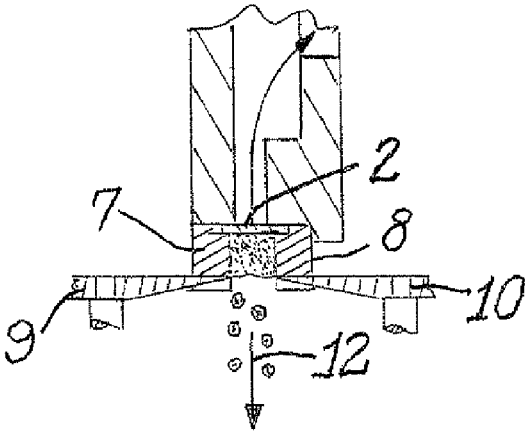
FIG. 43C shows a section 43C-43C of FIG. 43.
Figure 43D:
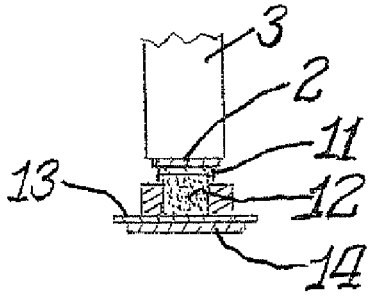
FIG. 43D shows a section 43D-43D of FIG. 43.
Figures 43E, 43F, 43G, 43H, 43I, 43J, 43K, 43L:
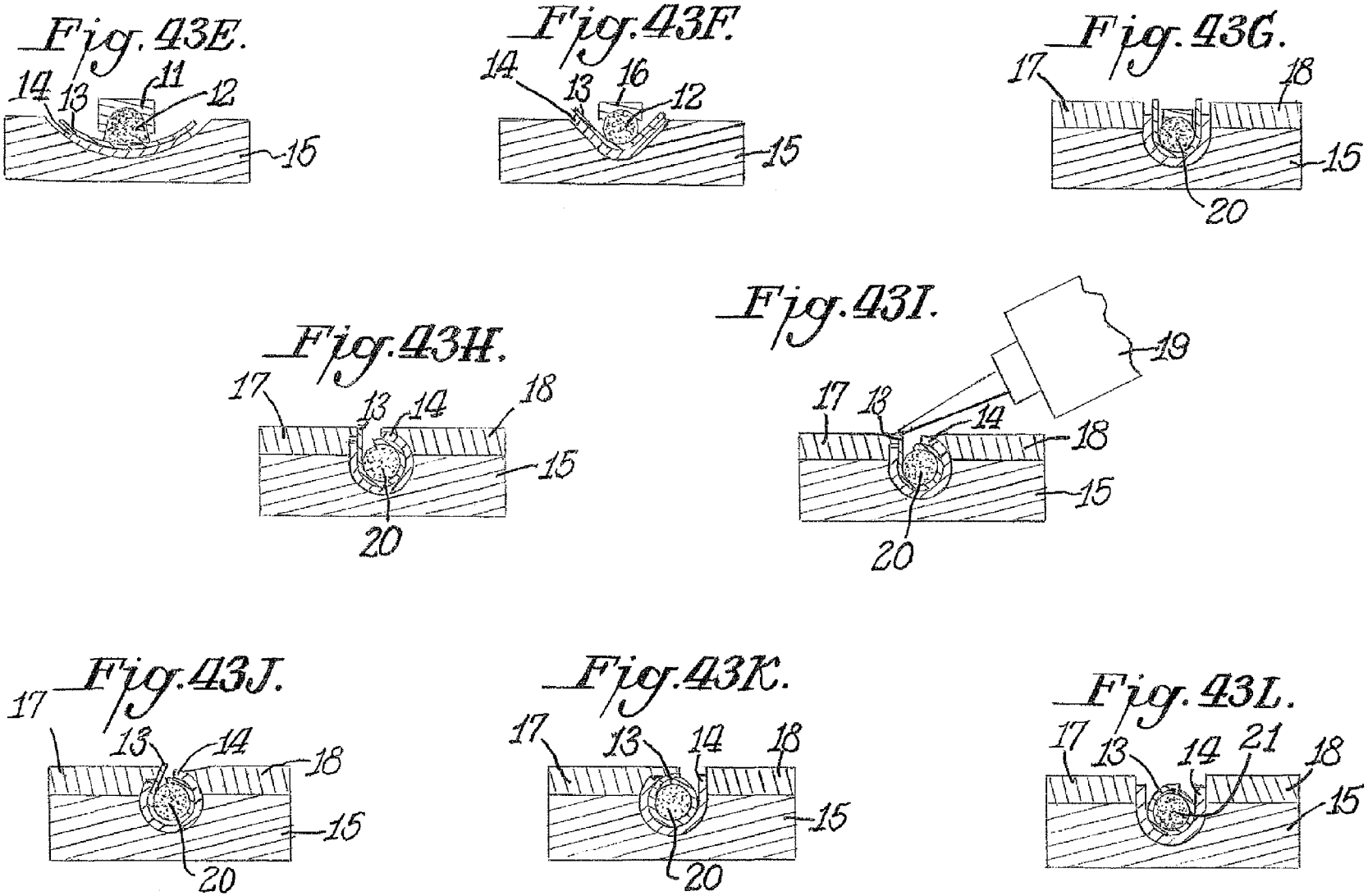
FIG. 43E shows a section 43E-43E of FIG. 43.
FIG. 43F shows a section 43F-43F of FIG. 43.
FIG. 43G shows a section 43G-43G of FIG. 43.
FIG. 43H shows a section 43H-43H of FIG. 43.
FIG. 43I shows a section 43I-43I of FIG. 43.
FIG. 43J shows a section 43J-43J of FIG. 43.
FIG. 43K shows a section 43K-43K of FIG. 43.
FIG. 43L shows a section 43L-43L of FIG. 43.

FIG. 42 shows a tobacco rod 71 with a hollow center mandrel 72. In particular, FIG. 42 shows a front folder 65, rear folder 69 resting on top of a garniture 70 and a drive belt 68 with the sealed tobacco rod 71 positioned within the garniture 70.

The foregoing description shows and describes the present invention. Additionally, the disclosure shows and describes only the preferred embodiments of the invention, but as mentioned above, it is to be understood that the invention is capable of use in various other combinations, modifications, and environments and is capable of changes or modifications within the scope of the inventive concept as expressed herein, commensurate with the above teachings and/or skill or knowledge of the relevant art. The embodiments described hereinabove are further intended to explain best modes known of practicing the invention and to enable others skilled in the art to utilize the invention in such or other embodiments and with the various modifications required by the particular applications or uses of the invention. Accordingly, the description is not intended to limit the invention to the form or application disclosed herein. Also, it is intended that the appended claims be construed to include alternative embodiments.

The invention claimed is:

1. A method for forming a hollow core tobacco rod comprising:

feeding a trimmed tobacco column to a wheel;

scraping the trimmed tobacco column from a porous drive belt;

pulling paper under the trimmed tobacco with a drive belt, wherein sides of the trimmed tobacco column are contained between front and rear rails;

widening and flattening the trimmed tobacco column against the paper;

forming the paper into a cylindrical shape around the tobacco column with a garniture;

passing tobacco column and paper under a tongue that further widens and flattens the tobacco column;

forming the paper into a cylindrical shape;

forming an inner hollow core with the tongue and a center mandrel;

rolling the rear portion of the tobacco and paper into a cylindrical shape with the garniture and a rear folder;

rolling the front of the trimmed tobacco column and paper into a vertical position with the garniture;

applying glue to the inner edge of the paper with a glue applicator;

forming the hollow core into a cylindrical shape with the center mandrel;

rolling the tobacco and paper into a circular shape with a front folder;

maintaining the hollow core shape with the center mandrel;

releasing the rear of the drive belt from the rear folder; wrapping the front edge of the paper over the rear edge with the front folder;

sealing the hollow core tobacco rod with glue from a glue applicator;

releasing the drive belt and lifting the sides of the belt into a vertical position; and outputting the sealed hollow core tobacco rod.

2. The method of claim 1, wherein a binder material is applied to the tobacco column during the step of widening and flattening.

3. An apparatus for forming a hollow core tobacco rod, comprising:

a porous drive belt;

a drive belt;

a wheel;

a scraper;

a garniture;

a tongue;

a center mandrel;

front and rear rails;

front and rear folders, and a glue applicator, wherein paper is pulled under a tobacco column with the drive belt; the scraper removes tobacco from the porous drive belt at the wheel, allows the tobacco column to widen, and begins to flatten the tobacco column against a paper; the garniture forms the paper into a cylindrical shape around the tobacco column; the tongue widens and flatten the tobacco column and, with the center mandrel, forms an inner hollow core tobacco rod; the garniture and the rear folder roll a rear portion of the tobacco and paper into a cylindrical shape; the garniture rolls the front of the tobacco and paper into a vertical position where glue is applied to an inner edge of the paper by the glue applicator; the center mandrel completes formation of the hollow core tobacco rod and maintains the shape of the hollow core tobacco rod; the front folder rolls the tobacco and paper into a circular shape; the rear folder releases a rear of the drive belt; the front folder wraps a front edge of the paper over a rear edge of the paper to seal the hollow core tobacco rod with glue from the glue applicator; and the front folder releases the drive belt further allowing the drive belt to lift into a vertical position allowing the sealed hollow core tobacco rod to exit the drive belt.

4. A method for forming a hollow core tobacco rod with an inner web material to support the hollow core, comprising:

feeding trimmed tobacco to a wheel;

removing a leading edge of the trimmed tobacco with a scraper from a porous belt;

pulling paper under the trimmed tobacco column with a drive belt, wherein sides of the trimmed tobacco column are contained by front and rear rails;

widening and flattening the trimmed tobacco column against the paper with a scraper and tongue;

feeding an inner core web material in at a matched speed matched to that of the trimmed tobacco column;

forming the paper, tobacco, and inner web material into a cylindrical shape around a center folder;

forming the inner hollow core with the center folder and the center mandrel;

rolling a rear portion of the tobacco, paper, and inner web core material into a cylindrical shape;

rolling the inner hollow core with a rear folder;

rolling the front of the tobacco, paper, and inner web material into a vertical position with the garniture;

applying glue to the inner edge of the paper with a glue applicator;

forming the inner core with the center mandrel;

rolling the tobacco, paper and inner web material into a cylindrical shape with the front folder;

maintaining the hollow core shape with the center mandrel;

maintaining the hollow core shape with the center mandrel;

releasing the rear of the drive belt with the rear folder;

wrapping the front edge of the paper over the rear edge with the front folder;

applying glue from the glue applicator;

maintaining the shape of the hollow core with the center mandrel;

releasing the drive belt from the front folder;

lifting the belt into a vertical position;

outputting the sealed, hollow core tobacco rod, with inner core web material.

5. The method of claim 4, wherein a binder material can be applied to the tobacco as it is being formed in the step of widening and flattening.

6. An apparatus for forming a hollow core tobacco rod with an inner web material to support the hollow core, comprising:

a porous drive belt;

a drive belt;

a wheel;

a scraper;

a garniture;

a tongue;

a center mandrel;

front and rear rails;

front and rear folders, and a glue applicator, wherein paper is pulled under a tobacco column with the drive belt; the scraper removes tobacco from the porous drive belt at the wheel, allows the tobacco column to widen, and begins to flatten the tobacco column against a paper; the garniture forms the paper, tobacco, and an inner web material into a cylindrical shape around a center folder, wherein the inner core web material fed in at a matched speed; the tongue widens and flatten the tobacco column and, with the center mandrel, forms an inner hollow core tobacco rod; the rear folder rolls a rear portion of the tobacco, paper, and inner web material into a cylindrical shape; the garniture rolls the front of the tobacco, paper, and inner web material into a vertical position where glue is applied to an inner edge of the paper by the glue applicator; the center mandrel completes formation of the hollow core tobacco rod and maintains the shape of the hollow core tobacco rod; the front folder rolls the tobacco, paper and inner web material into a cylindrical shape; the rear folder releases a rear of the drive belt; the front folder wraps a front edge of the paper over a rear edge of the paper to seal the hollow core tobacco rod with glue from the glue applicator; and the front folder releases the drive belt further allowing the drive belt to lift into a vertical position allowing the sealed hollow core tobacco rod with inner core material to exit the drive belt.

7. A method for forming a hollow core tobacco rod using extra wide paper to support the inner core, comprising:

feeding a trimmed tobacco column to a wheel;

removing trimmed tobacco column from the porous belt, with the leading edge of a scraper;

pulling an extra wide web of paper under the trimmed tobacco column with a drive belt and sides of the tobacco column being contained by front and rear rails;

widening and flattening the trimmed tobacco column against the paper with the scraper and tongue;

rolling the paper over the trimmed tobacco column;

wrapping the paper over the front edge of the trimmed tobacco column;

forming the tobacco and paper into a cylindrical shape around the tongue with the garniture;

forming the tobacco and paper into a hollow core with a rear folder and center mandrel;

rolling the tobacco and paper into a vertical position;

applying glue to the inner edge of the paper with a glue applicator;

rolling the tobacco and paper into a cylindrical shape;

maintaining the hollow core shape with the center mandrel;

releasing the rear of the drive belt from the rear folder;

wrapping the front edge of the paper over the rear edge with the front folder;

sealing the tobacco rod with glue from the glue applicator;

releasing the drive belt and lifting the edges of the drive belt into a vertical position; and outputting the sealed, hollow core tobacco rod.

8. The method of claim 7, wherein a binder material is applied to the trimmed tobacco column as it is being formed in the step of widening and flattening the tobacco column.

* * * * *